United States Patent [19]

Blumenthal

[11] Patent Number: 4,488,379

[45] Date of Patent: Dec. 18, 1984

[54] SPRING BALANCED DOOR

[76] Inventor: Ernesto Blumenthal, Avenida de Mayo, 1370 Buenos Aires, Argentina

[21] Appl. No.: 490,348

[22] Filed: May 2, 1983

[30] Foreign Application Priority Data

Nov. 26, 1982 [AR] Argentina ..... 291423

[51] Int. Cl.[3] ..... E05D 15/40

[52] U.S. Cl. ..... 49/206; 49/205

[58] Field of Search ..... 49/200, 197, 206, 205, 49/204, 203, 202, 201

[56] References Cited

U.S. PATENT DOCUMENTS 3,849,937 11/1974 Blumenthal ..... 49/205

FOREIGN PATENT DOCUMENTS 2251068 5/1974 Fed. Rep. of Germany ..... 49/203

*Primary Examiner*—Philip C. Kannan

*Attorney, Agent, or Firm*—McGlew and Tuttle

[57] ABSTRACT

A spring balanced door for closing a passage through a door frame comprises a closure panel having opposite lateral edges and movable from a closed position to an open position, fixed supports connected to the door frame at opposite sides of the passage, a vertical guide track connected on opposite sides of the door frame and rollers rotatably mounted to the panel at each lateral edge thereof and adjacent a lower corner of each lateral edge, movable in each track respectively. Rigid arms are connected to the panel at intermediate locations of each lateral edge and extend perpendicularly to a plane of the panel from an interior surface of the panel. A lever arm is journaled between each rigid arm and each support, with each lever arm pivotally connected to each rigid arm at a joint. A spring is connected between at least one of the supports and a corresponding lever arm with a stop provided on the support against which the lever arm stops during movement of the panel from its closed to its opened position. When the lever arm engages the stop, the panel continues its motion to its opened position by rotating about the joint.

12 Claims, 13 Drawing Figures

FIG. 1
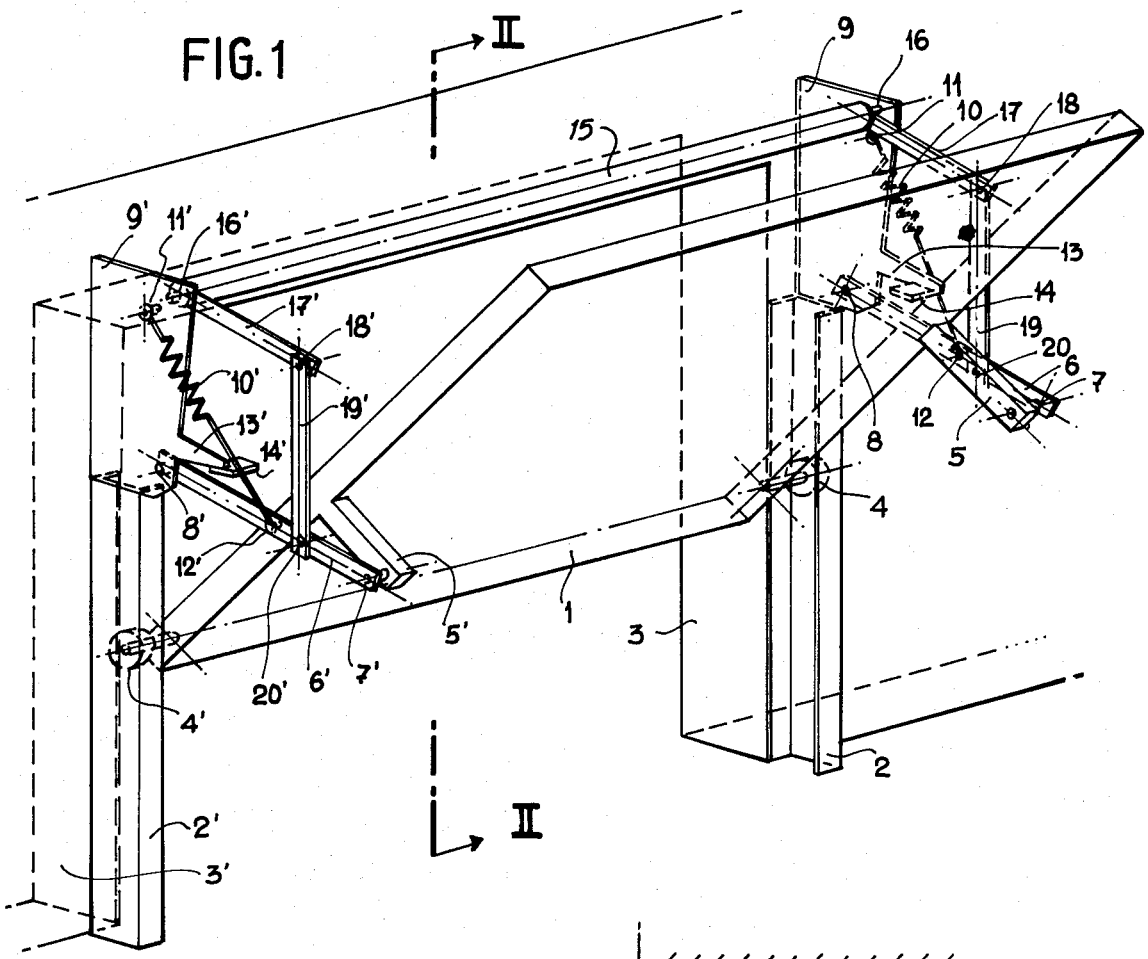
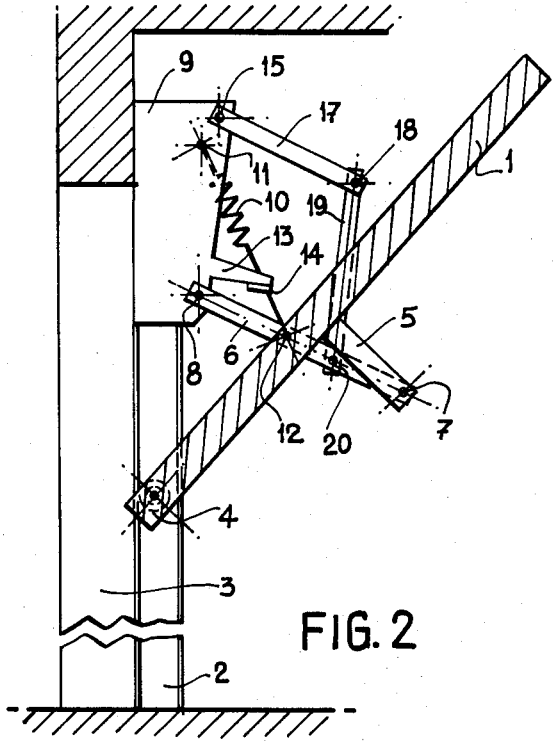
FIG. 2
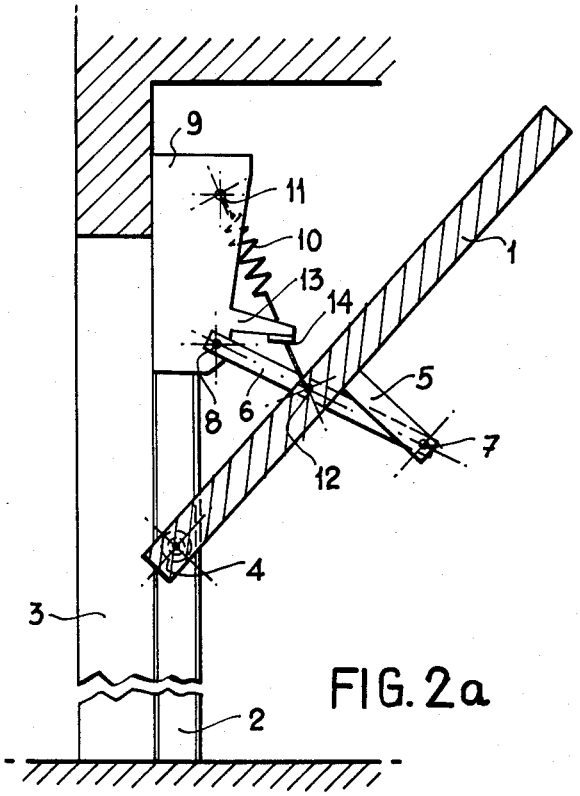
FIG. 2a

SPRING BALANCED DOOR

FIELD AND BACKGROUND OF THE INVENTION

The present invention relates in general to garage doors and in particular to a new and useful spring balanced door which includes arms rigidly connected to opposite edges of a door panel and extending perpendicularly to a plane of the door panel which are connected to biasing means for the door panel.

Overhead doors for buildings which consist of a displaceable panel which is movable toward the interior of the building by means of two lever arms and two lateral vertical tracks, are known in the art. In such doors the panel is normally balanced by counterweights or springs. Depending on the proper choice of the fulcra for the arms, the guidance elements and the balance elements, it is possible to achieve a correct equilibrium of the door panel. Moreover, since the door does not jut out from the building, it does not endanger passers-by. At the same time, it can be opened from inside the building, in particular the garage, even if there is snow in front of the door.

Another advantage of these doors is that the person operating them by hand does not have to stoop in order to open or close them.

Such doors have, however, the disadvantage that when being closed they get very near a dead point position which renders impossible, or at least makes very dangerous, the application of electro-mechanical drives.

Various earler embodiments of garage doors have been illustrated in the present inventor's Argentine Pat. Nos. 87,855 (dated Jan. 8, 1953); 123,046 (dated Aug. 29, 1960); 199,969 (dated Oct. 8, 1974); 203,723 (dated Oct. 15, 1975) and 209,202 (dated Mar. 31, 1977, as well as in his U.S. Pat. No. 3,849,937 (dated Nov. 26, 1974). It should be pointed out that in all these patents, where the door panel is balanced by counterweights or by springs, the inventor has tried to suspend this panel as centrally as possible in order to make easier a calculation of the remaining variables and to avoid having the panel out of balance.

SUMMARY OF THE INVENTION

In order to achieve a closure operation which is free of dead points in the present invention, the panel is suspended in a markedly eccentrical manner but without the door losing its spring balanced character and permitting the application of an electro-mechanical drive, without danger to persons and vehicles.

Another object achieved by the new door is to reduce the height required, from the floor to the ceiling, with the lever arms retaining the panel at a certain height, and in an inclined position, the total opening being completed by rotating the panel to its substantially horizontal position. By subdividing the opening movement into two parts, one guided and the other one an unguided rotational movement, it is also possible to avoid the danger of the leaf knocking against the lintel when the door is opened by hand in too sudden a manner.

Another advantage of this device consists in a considerable reduction of forces at the start, when closing the door due to the fact that the friction of a panel rotating in joints is minimal, and when opening it, because an opening tendency can be imparted to a panel in its closed position, whereby it is possible to reduce the power of the motor using a 1/5 HP motor instead of the $\frac{1}{3}$ HP motor currently used for electric openers of garage doors.

Finally the door which is the object of the present invention, can particularly be built in a compact form and to be prepared ready for shipment and installation, with the panel, the guide tracks and the mechanism assembled at the factory. If the door is to include electromechanical drive means, the latter may also be fitted at the factory and only has to be connected to the power source once the assembly has been put into place at the site.

The spring balanced door for the closure of passages, which is the object of the present invention, comprises a quandrangular closure panel provided at its lateral edges, near their lower corners, with respective coaxial guide rollers running in substantially vertical lateral guide tracks of U- or L-shaped profiles fixed to the structure of the building, two lateral lever arms journaled at one of their ends to supports in the fixed structure and at their other ends to the closure panel, and at least on spring journaled at one of its ends to a support in the fixed structure and at its other end to the corresponding lateral lever arm, the door being characterized in that the closure panel includes two rigid arms, which are perpendicular with respect to the plane of the panel, are directed toward the interior of the building and are fixed at intermediate locations on the lateral edges of the panel. The journaled attachment between the lever arms and the panel are carried out adjoining the free ends of the fixed arms. The spring balanced door has detention means capable of holding back at least one lever arm during an upward translational and rotational run of the panel into an upward inclined position toward the interior of the building. The axis of the joints between the rigid arms of the panel and the lever arms are the pole around which the panel completes its opening movement by rotating freely with regard to its guide rollers.

In an improved embodiment, this door includes a stabilizer device comprising a horizontal elongated bar, rotatable in supports, in the fixed structure and carrying at its ends two arms, which are integral, parallel and perpendicular with respect to the longitudinal axis thereof, the free ends of the arms being journaled to respective bars, the other ends of which are connected by journaling with the corresponding lateral lever arms.

In a special embodiment, the door is provided on one side only with a flexible traction element connected at both ends with a plate journaled to the axis of the guide roller and stretched between two pulleys anchored in the fixed structure, one of the pulleys being driven by an electrical motor by means of a speed reducer, both end stretches of the flexible traction element being substantially vertical and joined by means of the plate with the guide roller of the panel.

Accordingly another object of the present invention is to provide a spring balanced door which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

For a better understanding of the invention, several possible embodiments thereof will be described as illustrated, by way of non-limiting examples, in the drawings, wherein:

FIG. 1 is a perspective view of the inventive door in its half-open position;

FIG. 2 is a vertical section through the door of FIG. 1 taken along line II—II;

FIG. 2*a* is the same section as in FIG. 2, showing the door without its stabilizer;

DESCRIPTION OF THE PREFERRED EMBODIMENTS

Figure 3:
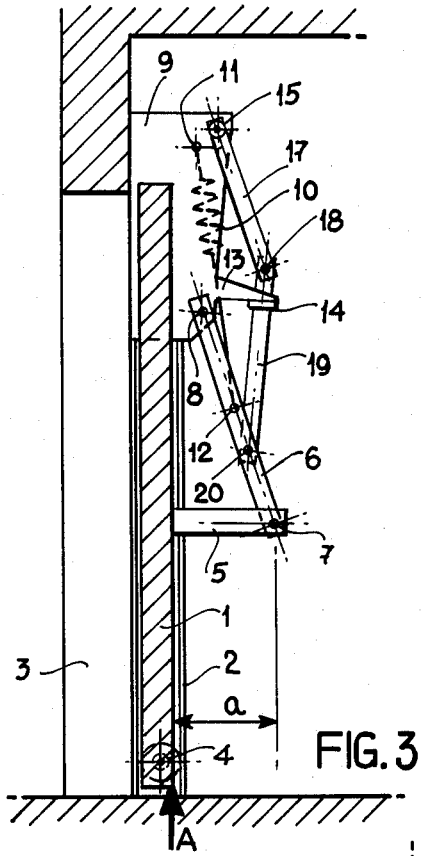
FIGS. 3 to 6 are diagrammatic representations of the door, in vertical section, in its various positions and showing the acting forces.

In the drawings, identical parts have the same reference numerals. Identical left and right hand elements of the mechanism have the same reference numerals with those on the left side of the drawings having a prime. To avoid confusion, structural elements are indicated with numerals, forces acting on these parts with capital letters and distances with lower-case letters.

With reference to FIG. 1 of the drawings, showing a spring balanced, manually operated door, the invention comprises a rectangular closure panel 1 and two vertical lateral guide tracks 2,2' having a U-shaped section connected to or embedded in the lateral walls or door frames 3,3' of a building. At both lateral edges, near its lower corners, panel 1 carries respective coaxial guide rollers 4,4' running in embedded vertical guide tracks 2,2'. At the same lateral edges, and substantially at central points thereof, the closure panel 1 carries two rigid arms 5,5' which are perpendicular with respect to the plane of panel 1 and parallel to one another. Two lever arms 6,6' are journaled at 7,7' to the ends of rigid arms 5,5' of panel 1, and at 8,8' to two fixed supports 9,9' (in this specific case, plates joined to the lateral guide tracks 2,2'). Two tension springs 10,10', journaled at 11,11' to the fixed supports at one of their ends (in this specific case the plates 9,9') and at their other end at 12, 12' to the respective lever arms 6,6', serve for balancing panel 1.

It will be appreciated that panel 1 is suspended by its rigid arms 5,5' from joints 7,7' in a clearly eccentric manner, wherein a dead point position is avoided when the door is closed. Two supports 13,13' fixed in the structure (in this specific case in the plates 9,9') carry stops 14,14' for the lever arms 6,6' acting during the rotation movement around the joints 7,7' in the final free opening movement of panel 1. For a better synchronization of the movements of the lateral assemblies, a horizontal stabilizing bar 15 is provided. This bar can be hollow and is rotatably held in respective bearings 16,16' placed on fixed supports in the structure (in this specific case, the plates 9,9'). This horizontal stabilizer 15 carries at both its ends, respective rigid arms 17,17' which are integral therewith, parallel to each other and perpendicular with respect to the rotational axis thereof. Arms 17,17' are journaled at their free ends 18,18' to the ends of respective straight bars 19,19', the opposite ends of which are journaled at 20,20' to lever arms 6,6'.

FIG. 2 is a sectional view through the same door, with panel 1, guide track 2, door frame 3, guide roller 4, rigid arm 5, lever arm 6 with its joint 7 on arm 5 and the other one 8 on plate 9, spring 10 with its joint 11 on the same plate 9 and the other one 12 on lever arm 6, support 13 with stop 14, bar 15, arm 17, joint 18 on straight bar 19 and joint 20 on lever arm 6.

In FIG. 2*a* the same door is shown but without the horizontal stabilizer bar 15, whereby rigid arms 17,17' and straight bars 19,19' with their corresponding joints are also eliminated. This embodiment can be used only for doors having smaller dimensions and very rigid panels, because it lacks stability in its movements, especially when the closure panel 1 is operated from one side only.

Figure 5:
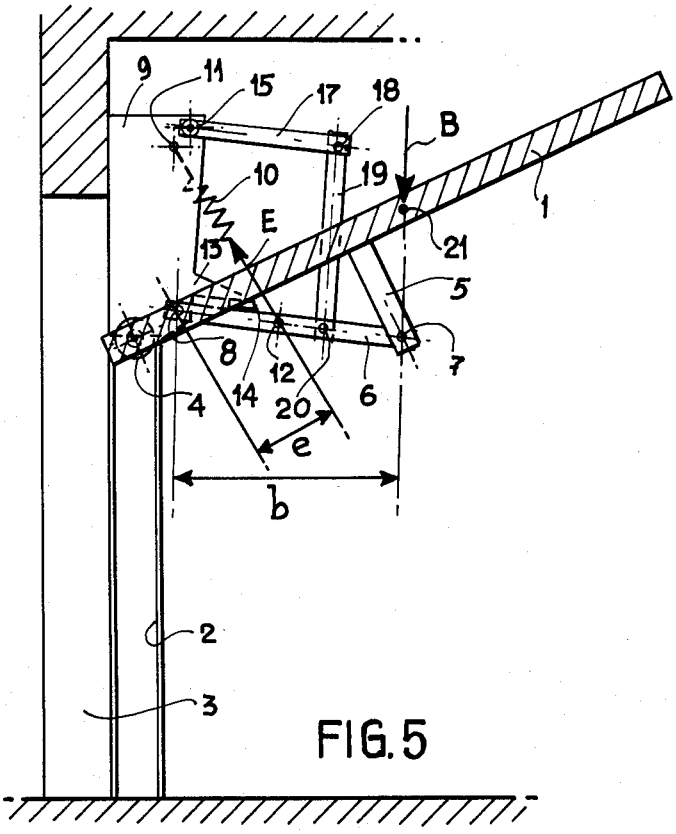
Figure 4:
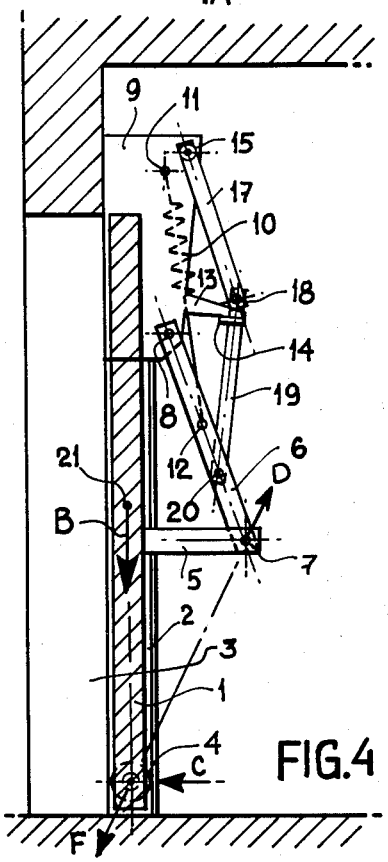
Figure 6:
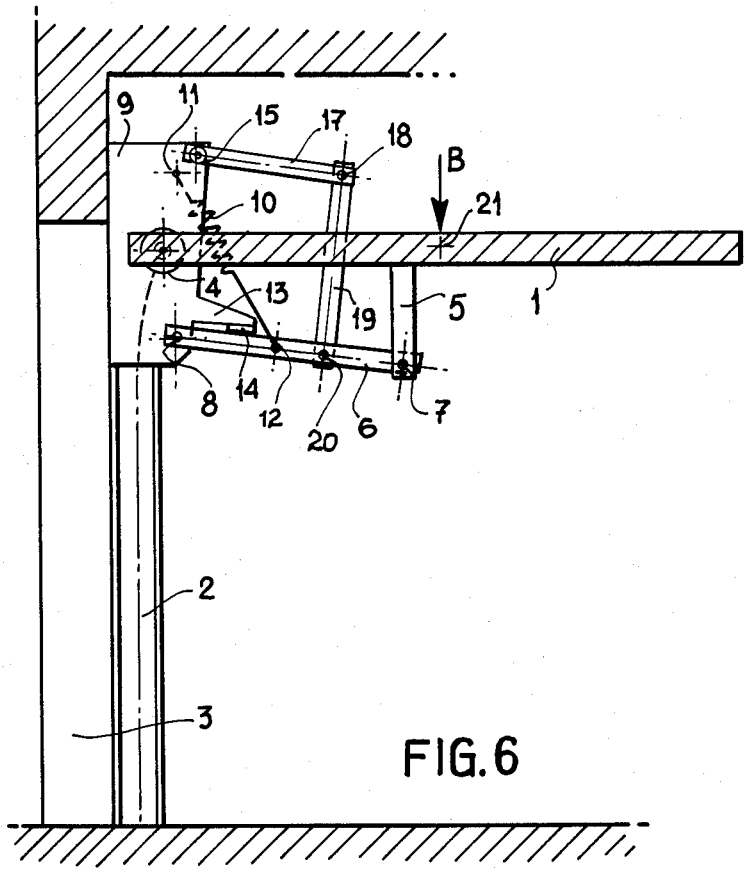

In FIGS. 3 and 4, the same door can be seen in vertical section and closed position, with FIG. 3 showing the effect of the eccentric suspension of panel 1, and with FIG. 4 showing how this effect can be counteracted with a view to achieving a proper balance of panel 1. FIG. 5 shows the door in a position wherein the rotational movement, unassisted by guidance of panel 1 starts, and FIG. 6 shows the substantially horizontal end position of the panel, once it has completed rotation around joint 7. In FIGS. 3, 4, 5 and 6, the elements comprising the door carry the same reference numerals as in FIG. 2.

In the diagrammatic illustration of FIG. 3, the effect of the eccentric suspension can be observed. The eccentric suspension of panel 1 produces in the case of a resistance force A on the lower edge of panel 1, a moment $A \times a$ with a being the distance between panel 1 and joint 7, which means that upon encountering resistance the panel 1 will turn to the inside. If the distance a between panel 1 and joint 7 were smaller or equal to zero, the movement of panel 1 would become dangerous, especially if driven by means of an electrical motor, because in the closing operation it would act as a guillotine. It is to be understood that an eccentrically suspended closure panel 1 has a tendency to knock when it is closed. The diagrammatic illustration of FIG. 4 shows how the knock can be avoided by selecting the proper kind of spring 10. On each side of panel 1, one half of its weight is acting, as shown by B in FIG. 4, and this weight acts vertically at the center of gravity 21 of the panel. A horizontal reaction C acts on the guide roller 4. Besides, a resulting force D acts, generated by the force of spring 10 on lever arm 6 in joint 7. For the device to be in equilibrium, the center of gravity 21, seen in this section, and the center of guide roller 4 must be on the same vertical line, and the resultant of forces B and C, shown at F, must have the same magnitude and direction as the resultant D on joint 7, said resultant F acting in a sense contrary to that of resultant D. Hereby it is possible to select a spring 10 which will comply with the conditions necessary for balancing the assembly, in spite of the eccentric suspension of the leaf.

However, occasionally spring 10 is selected so that a slight tendency to open panel 1 is caused, which is particularly convenient when it is desired to motorize the assembly.

FIG. 5 shows how panel 1 can be balanced also in the upper position of lever arm 6, when the latter meets stop 14. In this position, it is preferred for the guide roller 4 not to rest against guide track 2 but to remain free, which means that at this level guide track 2 ends. In this position the roller 4 no longer acts, and panel 1 rests freely on joint 7. It is imperative that the center of gravity 21 and the center of joint 7 be in the same vertical line for panel 1 to be balanced in this position. Furthermore, there must be a state of equilibrium between force B, i.e. one half of the weight of panel 1, and force E of spring 10 in this position, i.e. $B \times b = E \times e$, if b stands for the distance of force B from joint 8 of lever arm 6 and e stands for the distance between the same joint 8 and force E of spring 10. With this condition of equilibrium and the one mentioned in the description of FIG. 4 (closed door) the known statics means permit the calculation of springs 10,10' so as to avoid panel 1 from knocking when it is being closed and to assure that it will stay open in the positions shown in FIGS. 5 and 6. In practice, this will be sufficient to ensure the equilibrium of panel 1 in its intermediate position.

FIG. 6 shows the end position in the opening movement of panel 1, once the rotation of the panel around joint 7 has been completed. It is understood that in this position the half of weight B of panel 1 acting at the center of gravity 21 confers to panel 1 a slight tendency to unbalance due to not being anymore exactly on the vertical line passing through joint 7. However, this tendency is favorable inasmuch as it ensures that panel 1 remains safely in its open position and cannot be moved by possible gusts of wind.

The operation of the door is apparent from the foregoing description and illustrations. Upon being raised panel 1 shifts and moves upwardly due to the fact that guide rollers 4,4' pertaining to panel 1 run inside guide tracks 2,2'. Springs 10,10' cooperate in the upward movement. When lever arms 6,6' have arrived at the uppermost point of their path, they press against stops 14,14' and panel 1 stops moving upwardly and begins to rotate around joints 7,7' and finally assumes the horizontal upper position shown in FIG. 6. The closure of panel 1 is effected in a reverse sequence. Panel 1 is turned around joints 7,7' so that guide rollers 4,4' enter into their lateral guide tracks 2,2' and then panel 1 is lowered toward its closed vertical position as shown in FIG. 3.

Figure 8:
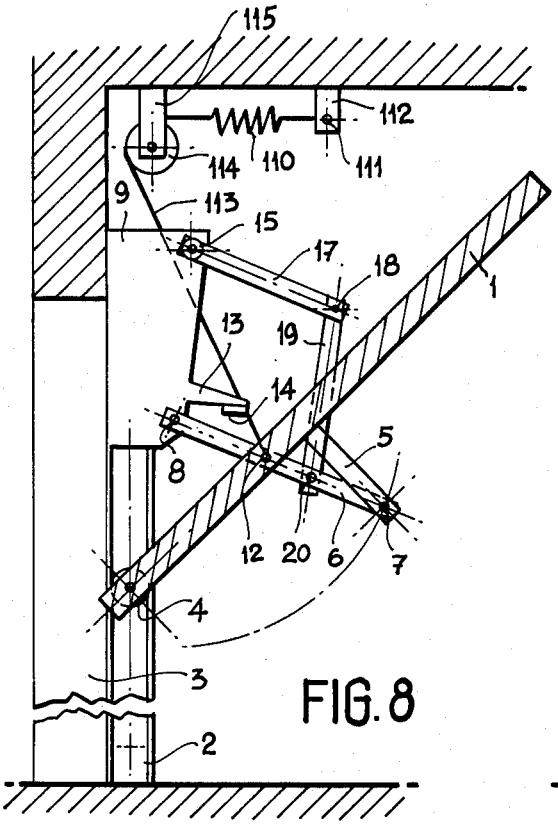
FIGS. 8 and 8*a* are diagrammatical vertical sections through a door having modified balancing means.
Figure 7:
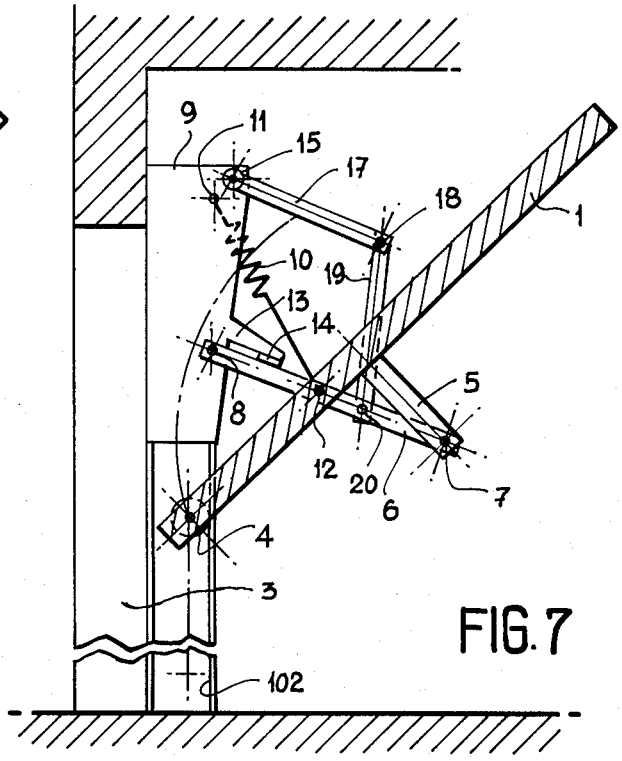
FIG. 7 is a diagrammatically vertical section through a door having modified guide tracks.
Figure 8A:
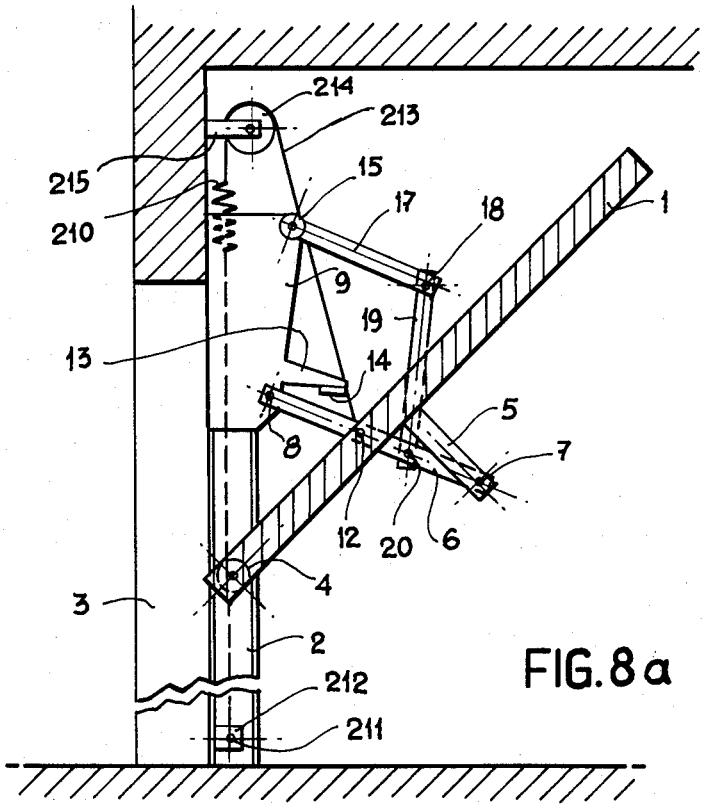

FIGS. 7, 8 and 8*a* show alternative embodiments of this invention. The elements comprising the door have the same reference numerals as in FIG. 2, with the exception of spring 10, which is renumbered 110 in FIG. 8 and 210 in FIG. 8*a*, and guide track, 2 which is renumbered 102 in FIG. 7.

FIG. 7 shows a guide track 102 having, at least in its upper portion, a widening enabling roller 4 to come out more easily at the beginning of the final and rotational part of its run. Once lever arm 6 has arrived at stop 14 and panel 1 begins to turn around joints 7,7', the lateral guide tracks become unnecessary. It is therefore sufficient that they reach only as far as this height of movement in order to enable rollers 4,4' to come out of them.

In the embodiment shown in FIG. 8, spring 110 is displaced to a point underneath the ceiling and joined at 111 with a fixed support 112 in the ceiling, while at its other end it is coupled in joint 12 to lever arm 6 by means of a cable 113 which is deflected by a pulley 114 turning in another support 115 fixed to the ceiling of the building.

FIG. 8*a* shows a spring 210, placed vertically alongside the guide track 2 and joined at 211 with a fixed support 212. The spring is coupled as before in joint 12 to lever arm 6 by means of a cable 213 which is deflected by a pulley 214 turning in another support 215 fixed near the ceiling of the building.

It is clear that the spring can be placed at any other suitable point of the building.

Figure 9:
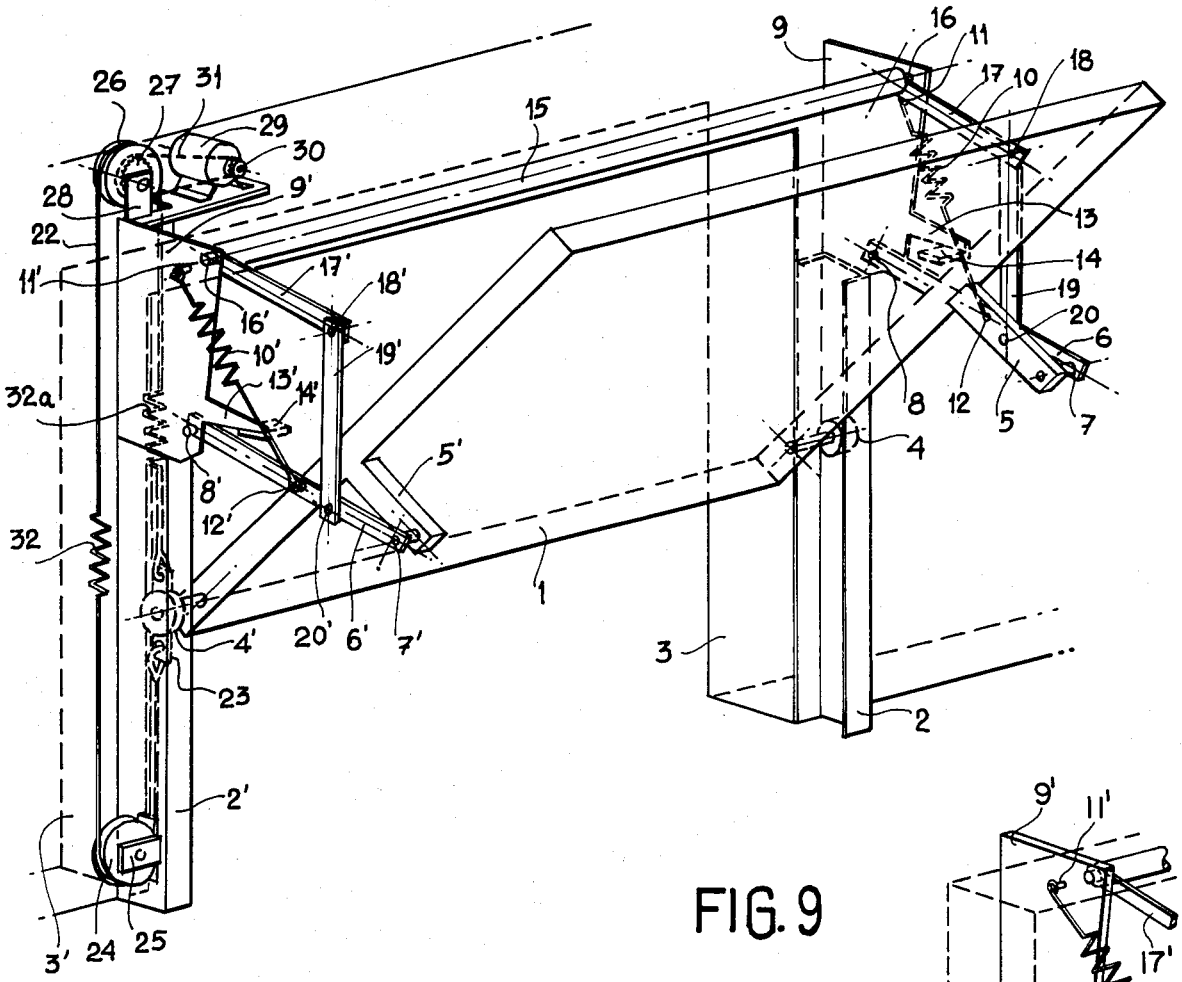
FIG. 9 is a perspective view of the door shown in FIG. 1, in a half-open position and provided with motorized driving means.

The door shown in FIG. 9 is the same as the one illustrated in FIG. 1 and therefore all its identical parts have the same reference numerals. For the sake of brevity, it will not be described in detail. Electromechanical and mechanical elements have been added so that the door can be opened and closed by merely pressing a push-button (not shown) which can be located at any suitable point, or else by using an electronic transmitter by means of which the door can be opened without getting out of the car when such a door is used to close a garage.

In this embodiment, a closed cable drive is shown. Cable 22 is connected by a plate 23 journaled on the axis of roller 4'. A deflection pulley 24, rotatable in a fixed support 25 (in this specific case provided on guide track 2') entrains cable 22. A driven pulley 26, integral with a toothed wheel 27 rotating in a fixed support 28 (in this specific case connected to plate 9') receives the transmission movement from a gear motor 29, the pinion 30 of which carries a chain 31 which also drives the toothed wheel 27. For a better operation two expansion springs 32, 32*a* can be inserted to sections of cable 22, one on each side of driven pulley 26 with a view ot prestressing cable 22. It is understood that the driving means can be transferred to other portions of the structure and that the movement, in that case, will be transmitted by means of additional deflection pulleys, such modifications being obvious for any specialist in the art. Furthermore, any other known driving system can be applied provided of course that it acts unilaterally on guide roller 4 or 4'. This unilateral action does not cause disturbances in the movement of the door due to the stabilizer bar assembly 15 which synchronizes the movement on both sides of panel 1. This drives moves panel 1 easily from its lower position shown in FIG. 3 to its upper position shown in FIG. 6 and vice versa. Due to the fact that at the start from the upper position very little friction must be overcome in joints 7,7' (rotation) and in the closed position a certain tendency to open can be given to panel 1 by choosing appropriate springs 10,10', the power of the motor can be reduced, for instance in the case of common garage doors, from $\frac{1}{3}$ HP, which is the usual amount, to 1/5 HP.

Figure 10:
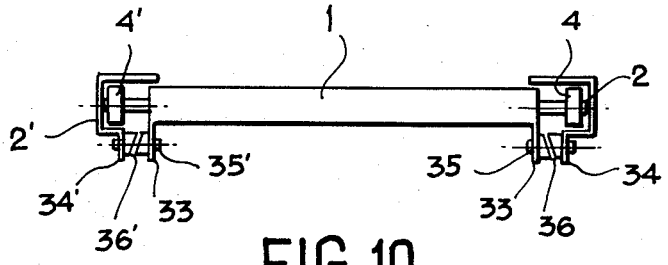
FIG. 10 is a top plan section through a door assembled ready for shipment.

By locating the guide and drive mechanism on the same plane as the door, the whole unit with its entire mechanism can be assembled at a factory and shipped to the site where it will be installed as a whole without disconnecting the parts. FIG. 10 shows how the parts of the assembly are joined together for transportation to the site. Thus panel 1 can be seen with its rollers 4,4' and lateral guide tracks 2,2', the protruding parts 33,33' of panel 1 being secured with flanges 34,34' of lateral guide tracks 2,2', by means of screws 35,35', preferably with insertion of cone-shaped spacers 36,36'. Once the guide tracks 2,2' are embedded at the site, screws 35,35' are removed. Then panel 1 is moved inwardly, whereby spacers 36,36' aided by their conical shape are caused to fall out, and the assembly is ready to operate.

Figure 1A:
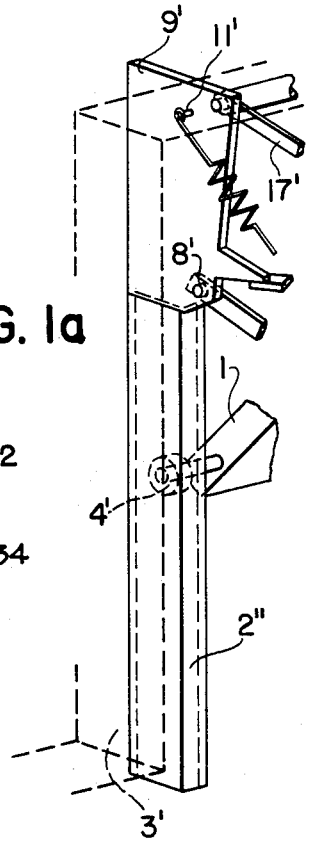
FIG. 1*a* is a perspective view of part of the door according to an alternate embodiment for a guide track of the door.

It is understood that in practice, modifications will be possible in the structural details of the assembly, by substituting some parts by other equivalent parts, without departing from the real scope of the invention as defined in the attached claims. Thus, for instance, stops 14,14', retaining lever arms 6,6' can be substituted by automatic locks or friction retainers, which, in this case, perform the same function, or else they can be provided with regulation screws. Springs 10,10' can be journaled to the corresponding lever arms 6,6', in their joints 12,12', or in the axis of joints 7,7' or in a special arm of lever arms 6,6' or else in extensions of same. In the motor-operated door (FIG. 9), the traction element, in this embodiment, a cable 22, can be substituted by a chain, but in such a case, it is advisable to insert in the drive a friction coupling in order to prevent accidents. Lateral guide tracks 2,2' can be L-sections instead of U-sections, as only one of their flanges acts as runway for rollers 4,4', because force C acting between guide track 2 and roller 4 and between guide track 2', and roller 4', respectively, always presses against the inner flange of the guide track (see FIG. 4). FIG. 1*a* shows one such L-shaped track numbered 2'', with some associated parts, as they are used and numbered in FIG. 1. Normally, the elements related to the equilibrium and the retention of guide tracks i.e. the springs and stops, are located on both sides of the panel. However, in very light doors, they may be located on one side only.

While specific embodiments of the invention have been shown and described in detail to illustrate the application of the principles of the invention, it will be understood that the invention may be embodied otherwise without departing from such principles.

What is claimed is:

1. A balanced door for closing a passage in a door frame, comprising:

a closure panel with opposite lateral edges and having a closed position and an open position which is at an angle to the closed position;

support means adapted to be connected to the door frame for establishing a fixed frame of reference;

two spaced substantially vertical guide tracks adapted to be connected to the door frame;

a guide roller connected to each lateral edge of said panel and each movable in one of said guide tracks;

a rigid arm connected to each lateral edge of said panel adjacent an intermediate location of each lateral edge, respectively, each rigid arm extending substantially perpendicularly to a plane of said panel and from an interior surface of said panel;

two lever arms, each journaled between one of said rigid arms and said support means, and each pivotally connected to a respective rigid arm at a pivot joint;

at least one biasing means connected between one of said lever arms and said support means for biasing said panel toward its open position; and stop means connected to said support means and engaged with at least one of said lever arms at an inclined position of said panel between its closed and open positions, said panel being further movable toward said opened position by rotation of said panel about said pivot joints.

2. A balanced door according to claim 1, wherein each of said guide rollers is rotatably mounted to a respective one of said lateral edges at lower corners of said panel, each guide track being one of a U-shaped track and an L-shaped track.

3. A balanced door according to claim 1, including an elongated substantially horizontal bar rotatably mounted to said support means, a pair of parallel stabilizer arms extending substantially perpendicular to a major axis of said horizontal bar and fixed at opposite ends of said horizontal bar, and a connector bar pivotally journaled between each stabilizer arm and each lever arm respectively.

4. A balanced door according to claim 1, wherein said stop means comprises a stop arm rigidly connected to said support means and a stop connected to an end of said stop arm for limiting upward movement of said at least one lever arm.

5. A balanced door according to claim 1, wherein, with said panel in its closed position, said biasing means is chosen to exert a force on said pivot joint which is substantially equal in magnitude and opposite in direction to a composite force on said guide roller exerted by said track on said guide roller and a half weight of said panel, said forces acting on a common line.

6. A balanced door according to claim 1, wherein, with said panel in its inclined position, a center of gravity of said panel lies on the same vertical plane as said pivot joint.

7. A balanced door according to claim 1, wherein each of said tracks extends vertically to a height so that each guide roller disengages from each track respectively when said panel reaches said inclined position.

8. A balanced door according to claim 1, including a protruding flange connected to said panel adjacent each lateral edge thereof, each lateral guide track having corresponding flanges with flanges of said panel and guide track having aligned openings, connecting means through said aligned openings for connecting said flanges in a stored state of said balanced door, and conical spacer elements positioned between said panel and track flanges for spacing said panel and track flanges in a stored state of said balanced door.

9. A balanced door according to claim 1, wherein said biasing means comprises a spring.

10. A balanced door according to claim 9, wherein said biasing means includes a flexible traction element connected at one end of said lever arm and an opposite end to said spring, at least one deflection pulley mounted on a fixed position for entraining said flexible traction element.

11. A balanced door according to claim 9, wherein said biasing means includes a plate journaled on an axis of rotation of said guide roller on one lateral edge of said panel, a pair of pulleys fixedly mounted to said track and support means, a flexible traction element entrained on said two pulleys and including an additional spring therein and drive means connected to one of said pulleys for driving said flexible traction element to move said panel between its closed and opened positions.

12. A balanced door according to claim 11, wherein said flexible traction means has two substantially vertical runs between said two pulleys, said additional spring in one of said runs and a further additional spring in the other of said runs.

* * * * *